US007695330B2

(12) United States Patent
Noda et al.

(10) Patent No.: US 7,695,330 B2
(45) Date of Patent: Apr. 13, 2010

(54) TERMINAL FITTING

(75) Inventors: Masahiro Noda, Yokkaichi (JP); Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/099,822

(22) Filed: Apr. 9, 2008

(65) Prior Publication Data

US 2008/0254673 A1 Oct. 16, 2008

(30) Foreign Application Priority Data

Apr. 13, 2007 (JP) ..... 2007-105474

(51) Int. Cl.
*H01R 4/10* (2006.01)

(52) U.S. Cl. ..... 439/877; 439/275

(58) Field of Classification Search ..... 439/877, 439/588, 589, 272, 273, 274, 275, 587
See application file for complete search history.

(56) References Cited

U.S. PATENT DOCUMENTS 5,484,961 A * 1/1996 Itoh et al. ..... 174/84 C
5,868,590 A 2/1999 Dobbelaere
6,953,365 B2 * 10/2005 Tabata et al. ..... 439/587
7,285,013 B1 * 10/2007 Tabata et al. ..... 439/587

FOREIGN PATENT DOCUMENTS

| | | |
|---|---|---|
| DE | 4414533 | 11/1994 |
| EP | 0786830 | 7/1997 |
| JP | 63123068 | 8/1988 |
| JP | 9092352 | 4/1997 |
| JP | 2002-203636 | 7/2002 |

* cited by examiner

*Primary Examiner*—Ross N Gushi
(74) *Attorney, Agent, or Firm*—Gerald E. Hespos; Michael J. Porco

(57) ABSTRACT

A terminal fitting has a base (11) for receiving a cylindrical sealing plug (70) mounted on an end of a wire (60) and crimping pieces (14F, 14R) projecting from opposite lateral edges of the base (11). The crimping pieces (14F, 14R) are crimped into connection at different positions of the outer circumferential surface of the sealing plug (70) in forward and backward directions. The base (11) is arranged Circumferentially along the lower half of the outer circumferential surface of the sealing plug (70) from its connected positions with the respective crimping pieces (14F, 14R) and includes receiving portions (16F, 16R) which have lateral edges (16E) facing the leading ends of the respective crimping pieces (14F, 14R) in circumferential direction and located at the upper half of the outer circumferential surface of the sealing plug (70).

4 Claims, 6 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2002-203636 and FIGS. 5 and 6 herein disclose a known terminal fitting with a base 2 for receiving a cylindrical sealing plug 3 mounted on an end of a wire. Two crimping pieces project from the opposite lateral sides 2A of the base 2 at different longitudinal positions along the sealing plug 3. The base 2 of the terminal fitting is supported on a fixed device 1. A movable device then is lowered to bend the crimping pieces inwardly and to wind the crimping pieces around the outer circumferential surface of the sealing plug 3. Thus, the terminal fitting and the sealing plug 3 are united.

As shown in FIG. 5, one lateral edge 2A of a base 2 facing the respective crimping pieces is located at a lower half of a sealing plug 3 and at the leading end of an outward arc. Thus, as shown in FIG. 6, there is a likelihood that the sealing plug 3 may get caught between the lowering movable device 1 and the lateral edge 2A of the base 2 to be damaged.

The present invention was developed in view of the above situation and an object thereof is to prevent the damage of a sealing plug.

SUMMARY OF THE INVENTION

The invention relates to a terminal fitting with a base for receiving a first part of a sealing plug mounted on an end of a wire. One or more crimping pieces project from at least one of the opposite lateral sides of the base. The respective lateral edges of the base portion substantially facing the respective leading sides of the respective crimping pieces in the circumferential direction are located above a height position with the maximum width of the sealing plug in the vertical direction. Thus, the lateral edges of the base smoothly come to be located below a movable device when the movable device is lowered from above. Therefore the sealing plug will not get caught between the movable device and the lateral edges of the base.

Two crimping pieces preferably project from the opposite lateral edges of the base, and the respective crimping pieces are to be crimped into connection at different positions of the outer circumferential surface of the sealing plug in forward and backward directions.

The lateral edges of the base portion facing the leading ends of the respective crimping pieces in the circumferential direction preferably include parts located one after the other in forward and backward directions at substantially the same height. Thus, a proper crimping force can be applied to the sealing plug.

The base portion preferably is formed with at least one step offset from the crimping pieces. The lateral edge of the step preferably is at substantially the same height as the lateral edges of the base substantially facing the respective leading ends of the crimping pieces in the circumferential direction.

The base preferably has at least one receiving portion that extends from the base ends of the respective crimping pieces in the circumferential direction along the lower portion of the outer circumferential surface of the mountable portion.

The crimping preferably is carried out so that the outer shape of the mountable portion that was originally a right circular shape is deformed substantially into a vertically long elliptical shape.

The crimping pieces preferably come to have a substantially oblong C-shape.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
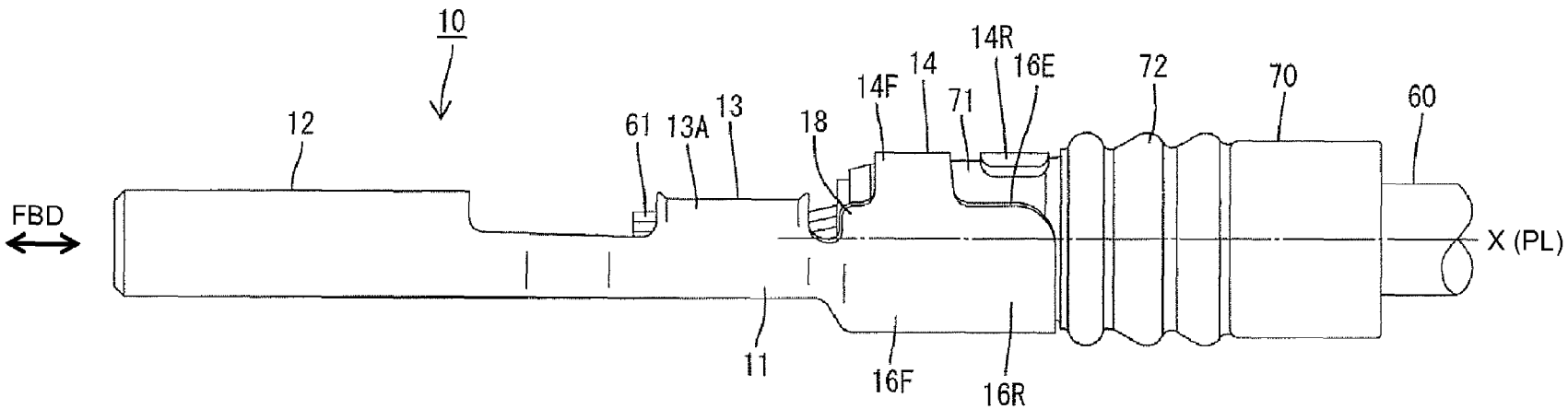
FIG. 1 is a side view of a terminal fitting connected with a wire and a sealing plug in one embodiment of the invention.

A female terminal fitting in accordance with the invention is identified by the numeral 10 in FIGS. 1 to 4 and is formed by, for example, bending, folding and/or embossing an electrically conductive metal plate. The terminal fitting 10 is to be accommodated in an unillustrated female connector and is to be electrically connected with a male terminal fitting by connecting the female connector and a mating male connector. In the following description, an arranged side of a fixed device 80 upon bending the terminal fitting 10 is referred to as a lower side and that of a movable device 90 is referred to as an upper side concerning the vertical direction.

The terminal fitting 10 includes a base 11 that is long and narrow in forward and backward directions FBD. A main portion 12 is formed at the front end of the base 11, and wire crimping portions 13, 14 are formed near the rear end of the base 11. The main portion 12 has a rectangular tubular shape with an open front end, and is provided with an internal portion to be held in contact with the mating male terminal fitting to be inserted from front.

The crimping portions 13, 14 are to be connected with an end of a wire 60 and comprise at least one wire barrel 13 located at a front position and at least one insulation barrel 14 located at a rear position. The wire barrel 13 includes two crimping pieces 13A to be crimped, bent or folded into connection with an exposed core 61 at the end of the wire 60. The respective crimping pieces 13A are arranged to substantially face each other at the same position in forward and backward directions FBD and project from the opposite lateral edges at the rear side of the base 11. The crimping pieces 13A are bent substantially in U-shape upon being crimped.

A sealing plug 70 is mounted on an insulation coating near the end of the wire 60. The sealing plug 70 is made of a resilient material, such as rubber, and has a substantially cylindrical shape. The sealing plug 70 can be pressed into contact with an inner circumferential surface of a cavity in a female connector to provide waterproofing. A thin mountable portion 71 with a right circular cross section is formed near the front end of the sealing plug 70 and is received by the rear side of the base 11 from below. The insulation barrel 44 can be wrapped at least partly around the mountable portion 71 from a side opposite the base 11 (i.e. from above). Lips 72 are arranged substantially side by side behind to the mountable portion 71.

The insulation barrel 14 includes front and rear crimping pieces 14F, 14R that project from the opposite lateral edges near the rear end of the base 11. Specifically, the front crimping piece 14F projects from the left edge of the rear side of the base 11 and the rear crimping piece 14R projects from the right edge. The front crimping piece 14F is located before the rear crimping piece 14R in forward and backward directions FBD. In other words, the respective crimping pieces 14F, 14R are arranged to be crimped, bent or folded at different positions on the outer circumferential surface of the mountable portion 71 in forward and backward directions FBD, and the front crimping piece 14F is wound around a relatively more forward portion of the mountable portion 71 while the rear crimping piece 14R is wound a relatively more backward portion of the mountable portion 71.

The crimping pieces 14F, 14R are substantially rectangular plates formed to extend circumferentially along an upper part of the outer circumferential surface of the mountable portion 71 substantially opposite to the base 11. More particularly, the crimping pieces 14F, 14R are crimped to extend along an outer circumferential surface area above the maximum width of the mountable portion 71 and above an imaginary horizontal plane PL that contains the longitudinal axis of the mountable portion 71. Leading ends of the crimping pieces 14F, 14R appear to overlap when viewed from the front, but actually are displaced along the forward and backward directions FBD. In other words, the crimping pieces 14F, 14R project from the base 11 by a distance that is greater than the distance from the part of the mountable portion 71 to be arranged on the base 11 to the plane PL containing the longitudinal axis of the mountable portion 71 and intersecting the maximum width area of the mountable portion 71. Accordingly, the crimping pieces 14F, 14R wrap at least partly around the mountable portion 71 beyond its part having the maximum width.

The rear end of the base 11 includes front and rear receiving portions 16F, 16R that extend from the base ends of the respective crimping pieces 14F, 14R in circumferential direction along substantially the lower half of the outer circumferential surface of the mountable portion 71 below the substantially horizontal plane PL that contains the longitudinal axis of the mountable portion 71 and that defines the maximum width of the mountable portion 71. More specifically, the front receiving portion 16F extends unitarily forward from the front crimping piece 14F and the rear receiving portion 16R extends unitarily rearward from the rear crimping piece 14R. Thus, the front receiving portion 16F is before the rear receiving portion 16R. Lateral edges 16E of the respective receiving portions 16F, 16R opposite the lateral edges where the respective crimping pieces 14F, 14R project are in a positional relationship to face the leading ends of the corresponding crimping pieces 14F, 14R in parallel in circumferential direction, as shown in FIGS. 1 and 2.

Figure 2:
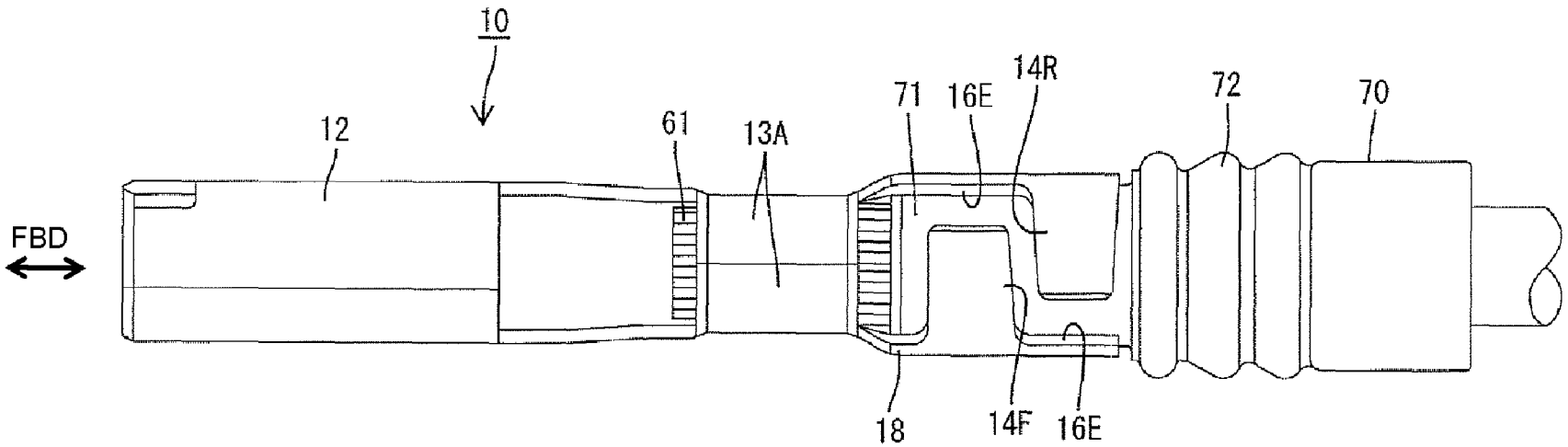
FIG. 2 is a plan view of the terminal fitting connected with the wire and the sealing plug.

These lateral edges 16E of the base 11 are located near the leading ends of such inward arcs to approach the crimping pieces 14F, 14R while extending along an upper part of the outer circumferential surface of the mountable portion 71 above a center line X of the sealing plug 70 in the vertical direction as shown in FIG. 1, and hence above the maximum width area that and contains the plane PL. Thus, these lateral edges 16E of the base 11 are located on the upper half of the outer circumferential surface of the mountable portion 71.

The lateral edges 16E of the receiving portions 16F, 16R have parts that extend substantially continuously at the same height in forward and backward directions FBD. The base 11 also is formed with a step 18 continuous with the wire barrel 13 and at the front of the front crimping piece 14F substantially opposite to the rear receiving portion 16R. The lateral edge of the step 18 is at substantially the same height as the lateral edges 16E of the receiving portions 16F, 16R.

Figure 3:
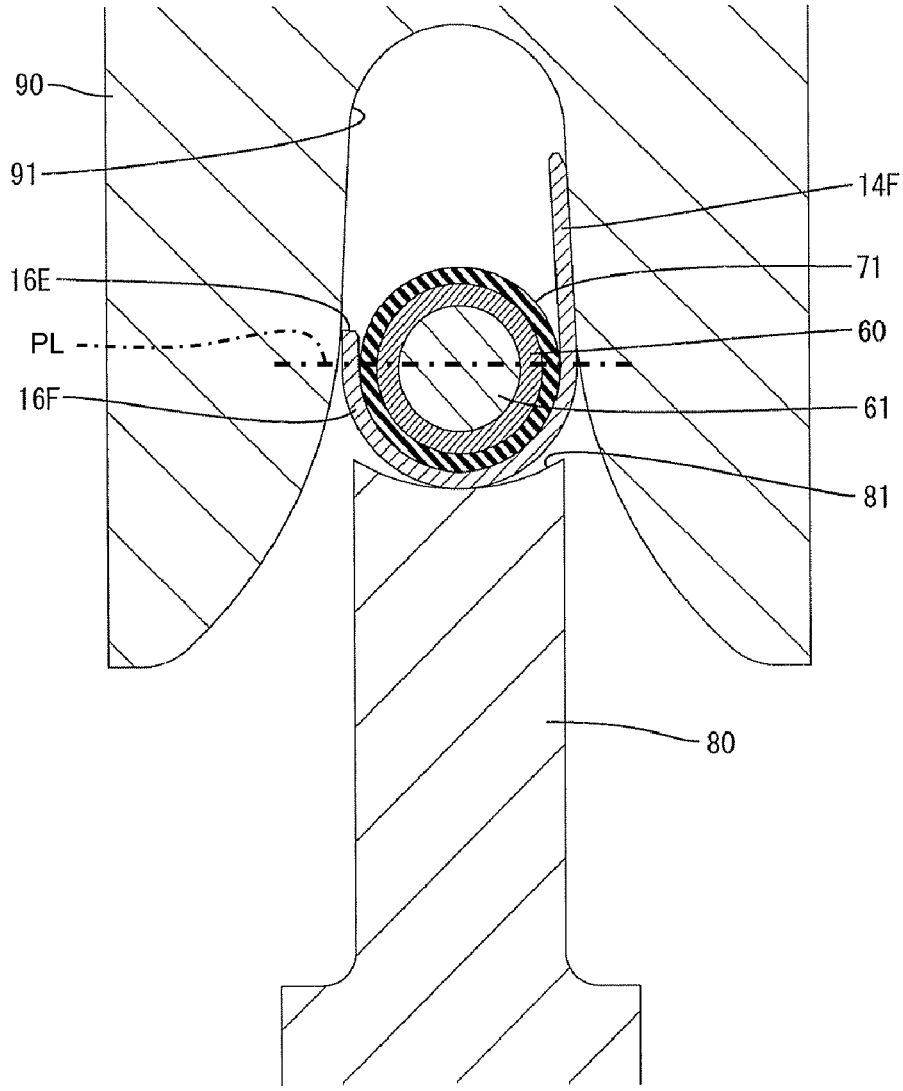
FIG. 3 is a vertical section showing a state where crimping pieces are being crimped into connection with the sealing plug.

The mountable portion 71 of the sealing plug 70 is mounted on the end of the wire 60 and is supported on the insulation barrel 14 of the base 11 with the crimping pieces 14F, 14R held open in the form of an open barrel. Subsequently, as shown in FIG. 3, the insulation barrel 14 is inserted into an accommodation recess 81 of the fixed device 80 for bending or folding and the movable device 90 is displaced towards the fixed device 80 in this state. The movable device 90 has a concave arcuate lower pressing surface 91 that is moved into contact with the outer surfaces of the respective crimping pieces 14F, 14R. Thus, the crimping pieces 14F, 14R are bent inwardly or substantially towards each other. The crimping pieces 14F, 14R are folded or wound at least partly around the outer circumferential surface of the mountable portion 71 of the sealing plug 70 while extending substantially along the pressing surface 91 as the movable device 90 is displaced farther down. The outer surfaces of the lateral edges 16E of the receiving portions 16F, 16R also are contacted by the pressing surface 91 of the movable device 90 and are bent inwardly while sliding in contact with the pressing surface 91.

Figure 4:
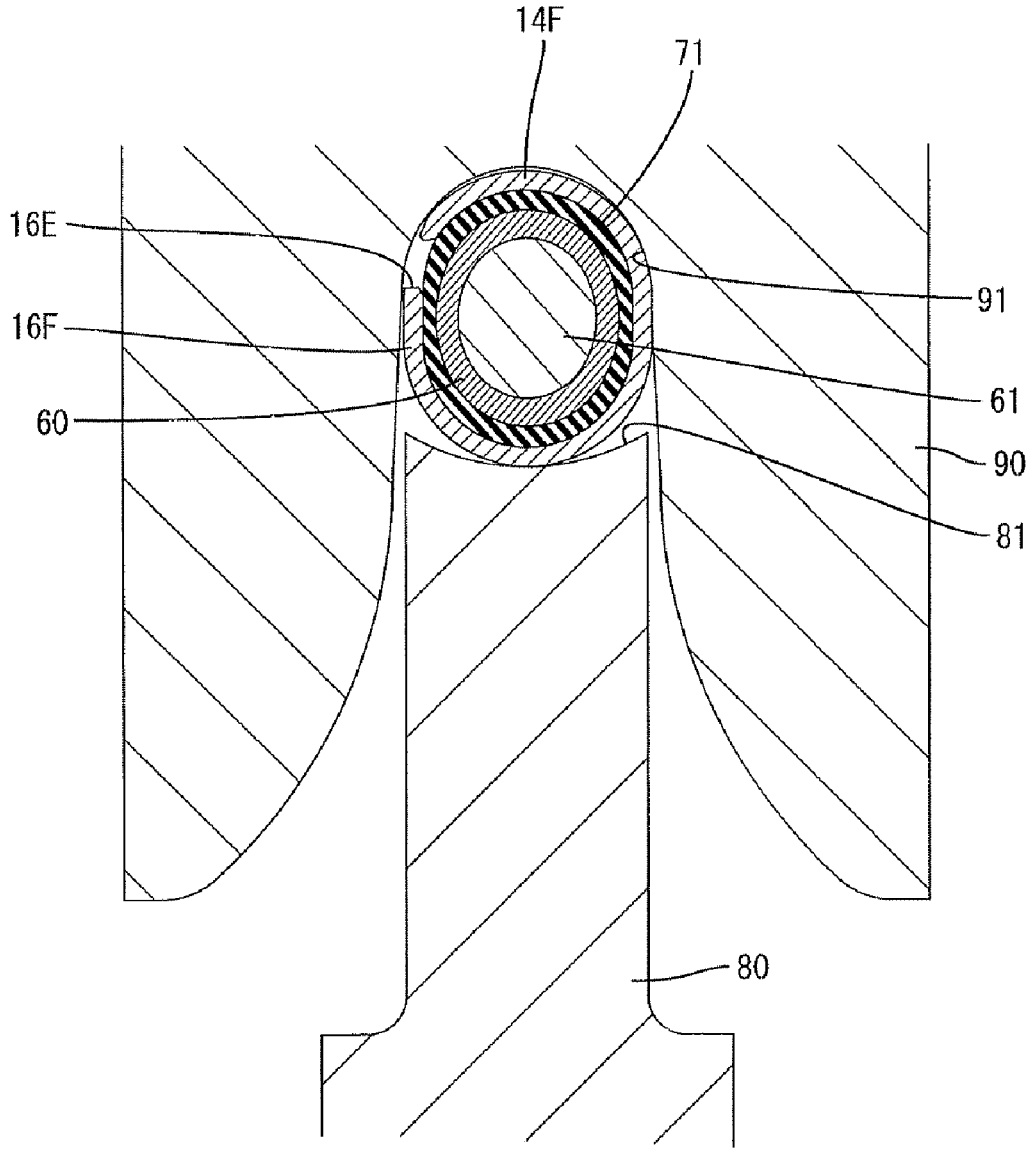
FIG. 4 is a vertical section showing a state where the crimping pieces are crimped into connection with the sealing plug.
Figure 5:
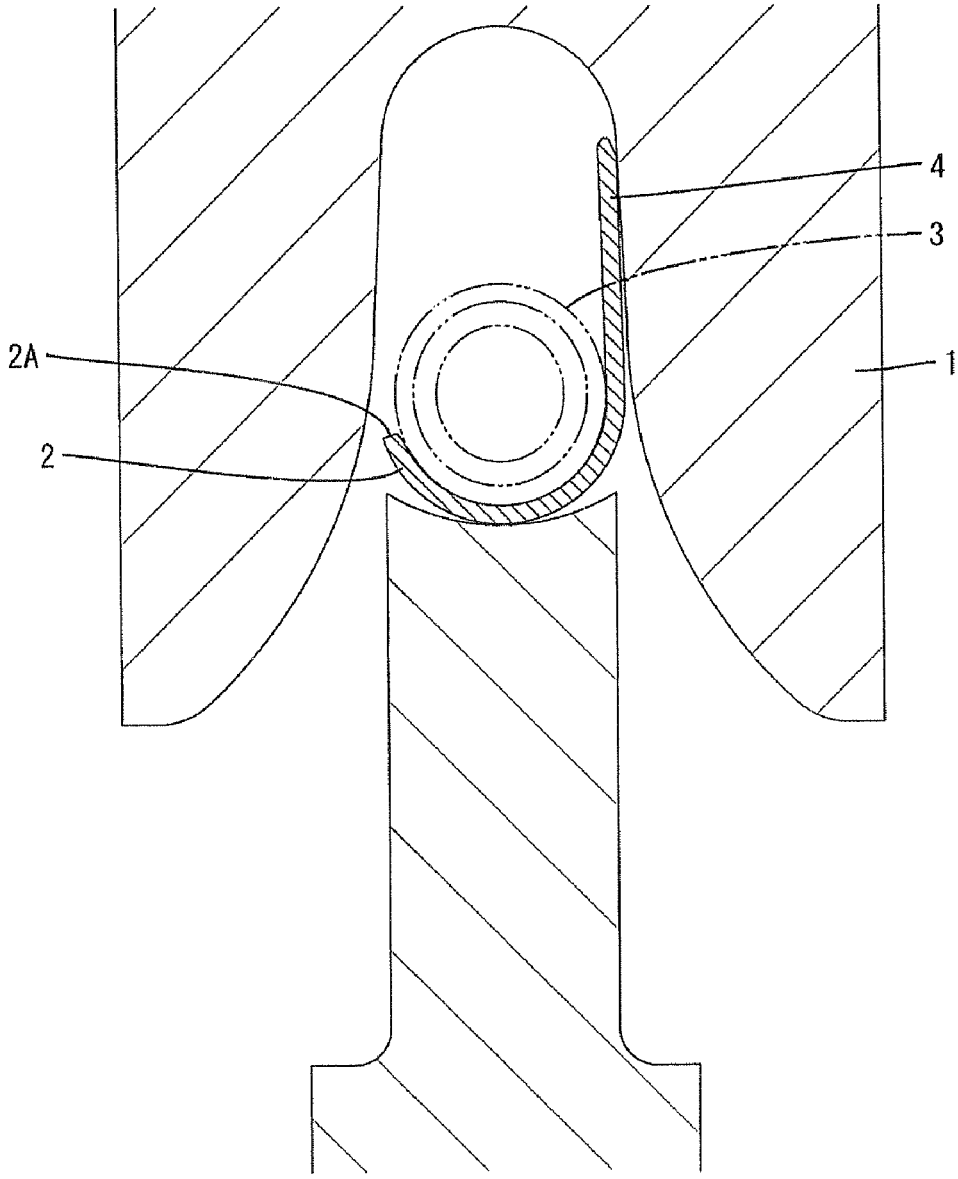
FIG. 5 (PRIOR ART)
FIG. 5 is a vertical section, corresponding to FIG. 3, showing a prior art.
Figure 6:
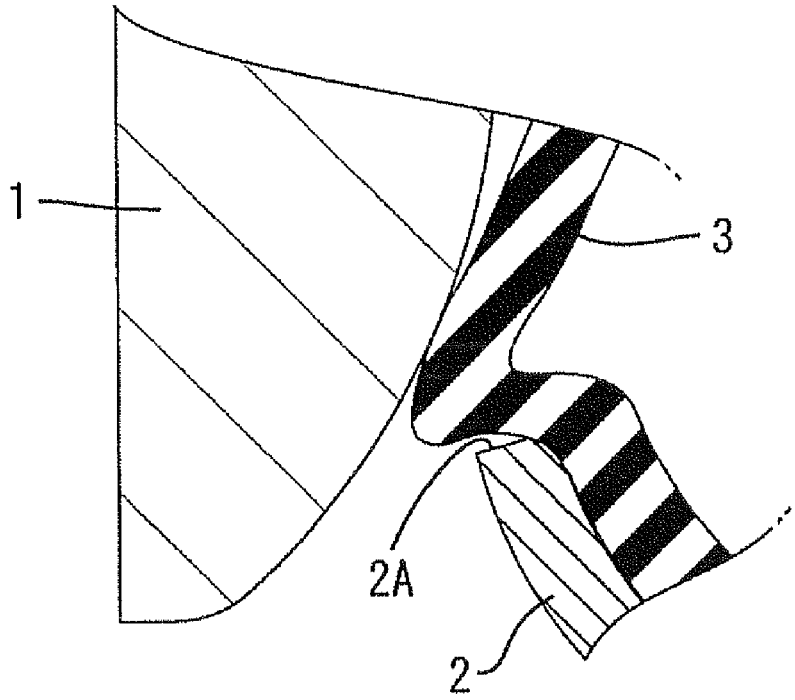
FIG. 6 (PRIOR ART)
FIG. 6 is an enlarged vertical section showing an essential portion of the prior art.

The wound crimping pieces 14F, 14R are crimped into connection with the outer circumferential surface of the mountable portion 71 and the lateral edges 16E of the receiving portions 16F, 16R are in close contact with the outer circumferential surface of the mountable portion 71, when the movable device 90 reaches a proper depth, as shown in FIG. 4. At this time, the opposite left and right sides of the mountable portion 71 are pressed inwardly by the pressing surface 91 of the movable device 90 to be squeezed. Thus, the original right circular outer shape of the mountable portion 71 is deformed into a vertically long elliptical shape. Similarly, the crimping pieces 14F, 14R and the receiving portions 16F, 16R are deformed into a vertically long C-shape. The sealing plug 70 and the insulation barrel 14 are formed vertically long to arrange cavities of the female connector for accommodating the terminal fittings 10 at narrower intervals.

A large pressing force is applied by the movable device 90, and there is a risk of considerably damaging the sealing plug 70. Specifically, the sealing plug 70 could get caught between the other lateral edges 16E of the respective receiving portions 16F, 16R and the pressing surface 91 of the movable device 90 (in an open part of the C-shape).

However, the lateral edges 16E of the respective receiving portions 16F, 16R are at the upper portion of the outer circumferential surface of the mountable portion 71 and smoothly come to be located below the pressing surface 91 of the movable device 90 as the movable device 90 is lowered. Thus, the sealing plug 70 is not likely to be damaged by the movable device 90 can be reduced or prevented. Further, the lateral edges 16E of the receiving portions 16F, 16R have the parts continuously at the same height in forward and backward directions FBD so that a proper crimping force can be applied to the sealing plug 70.

The invention is not limited to the above described and illustrated embodiment. For example, the following embodiments are also embraced by the technical scope of the present invention as defined by the claims.

The front crimping piece may project from the right edge of the base and the rear crimping piece may project from the left edge of the base.

The other lateral edges of the receiving portions may be curved to have different heights in forward and backward directions.

The receiving portions may be partly thinned.

It is sufficient for the mountable portion to have a round cross section and the mountable portion needs not have a right circular cross section.

The present invention is applicable to male terminal fittings.

What is claimed is:

1. A terminal fitting assembly, comprising:

a substantially tubular sealing plug mounted on an end of a wire, the sealing plug having opposite front and rear ends spaced apart along a center line, a substantially tubular mounting portion being defined substantially adjacent the front end of the sealing plug; and a terminal fitting having opposite front and rear ends, an insulation barrel having a longitudinally extending spine and opposite first and second lateral sides extending from the spine, first and second crimping pieces projecting respectively from the first and second sides of the base at positions spaced longitudinally along the insulation barrel, first and second lateral edges formed respectively on the opposite first and second lateral sides of the insulation barrel, the first lateral edge being opposite to the second crimping piece and the second lateral edge being opposite to the first crimping piece, the first and second lateral edges projecting sufficiently so that the center line of the mounting portion of the tubular seal is between the spine of the insulation barrel and a first plane that connects locations on the first and second lateral edges farthest from the spine, the first crimping piece being crimped around the tubular mounting portion of the sealing plug and toward the first lateral edge of the insulation barrel, the second crimping piece being crimped around the tubular mounting portion of the sealing plug and toward the first lateral edge of the insulation barrel, the insulation barrel having a second plane that passes through the center line of the sealing plug and symmetrically through the spine of the insulation barrel, an outside cross dimension of the insulation barrel along the second plane and perpendicular to the center line exceeding a maximum outside cross sectional dimension of the insulation barrel measured parallel to the first plane and perpendicular to the center line so that the insulation barrel defines a long elliptical shape.

2. The terminal fitting of claim 1, wherein the first lateral edge is substantially adjacent the first crimping piece and the second lateral edge is substantially adjacent the second crimping piece.

3. The terminal fitting of claim 1, wherein the first and second lateral edges are in a common plane.

4. The terminal fitting of claim 1, wherein the first and second lateral edges are spaced from one another circumferentially by more than 180 degrees.

* * * * *